US007060085B2

(12) United States Patent
Graham et al.

(10) Patent No.: US 7,060,085 B2
(45) Date of Patent: Jun. 13, 2006

(54) ROCKING VECTORED PNEUMATIC JOINT SEPARATOR

(75) Inventors: Richard A. Graham, 18584 Main St., Huntington Beach, CA (US) 92648; Denise M. Pauck, Huntington Beach, CA (US)

(73) Assignee: Richard A. Graham, Huntington Beach, CA (US)

( * ) Notice: Subject to any disclaimer, the term of this patent is extended or adjusted under 35 U.S.C. 154(b) by 532 days.

(21) Appl. No.: 10/409,906

(22) Filed: Apr. 8, 2003

(65) Prior Publication Data

US 2004/0204742 A1 Oct. 14, 2004

(51) Int. Cl.
*A61H 1/02* (2006.01)

(52) U.S. Cl. ..... 606/240; 606/237; 128/845; 601/5; 601/148; 601/134

(58) Field of Classification Search ..... 601/148, 601/150, 151, 55, 75, 96, 105, 23, 24, 90, 601/91, 98, 134, 138; 606/240; 602/13; 128/DIG. 20, 845; 482/146
See application file for complete search history.

(56) References Cited

U.S. PATENT DOCUMENTS

| | | | | |
|---|---|---|---|---|
| 4,135,503 A | * | 1/1979 | Romano | 602/13 |
| 5,070,865 A | * | 12/1991 | Iams | 606/240 |
| 5,279,310 A | | 1/1994 | Hsien | |
| 5,569,176 A | | 10/1996 | Graham | |
| 5,713,841 A | | 2/1998 | Graham | |
| 5,906,586 A | | 5/1999 | Graham | |

* cited by examiner

*Primary Examiner*—Danton Demille
*Assistant Examiner*—Manuj Agarwal
(74) *Attorney, Agent, or Firm*—Walter A. Hackler

(57) ABSTRACT

An abdominal muscle and spine exercising device includes a frame having a top and a bottom surface with first and second bladders disposed on the top surface for bearing directly against thoraco-lumbar and lumbo-sacral vertebrae of a users spine in vectored directions in order to enhance an elliptical arch in the lower spine. A second arch projection is disposed on the bottom surface of the frame for enabling the frame and bladders to be rocked by the user in a transverse direction to a longitudinal axis of the frame.

10 Claims, 4 Drawing Sheets

ROCKING VECTORED PNEUMATIC JOINT SEPARATOR

FIELD OF THE INVENTION

The present invention relates to an exercising device and more specifically relates to an abdominal muscle and a vectored pneumatic joint separator in order to promote fluid imbibition through the spinal column.

BACKGROUND ART

The spinal column is a bony column forming the main structural support of the skeleton of a human being and it consists of bony vertebrae linked by flexible joints and held together by ligaments and flexible gelatinous discs of cartilage. The spinal column of an adult human being consists of thirty-three vertebrae in which the last nine of these are fused to form the sacrum and the coccyx at the back of the pelvis. It is known that the spine has a number of curvatures along the sagittal plane, namely, the cervical and lumbar curvatures in which the spine is convex toward the front of the body and the dorsal and sacral curvatures in which the spine is convex toward the back of the body. These alternating curves provide strength and balance to the body and are essential to allowing a person to walk upright.

The lumbar and cervical curves of the spine normally define forward curves of about 35 to about 45 degrees whereby weight is distributed relatively evenly on individual vertebral surfaces and discs. In individuals with lost or reversed cervical and lumbar spinal curves due to injury, illness, genetic predisposition, habitual microtrauma or simply poor posture, the weight of the body bears forwardly on the soft, non-bony intervertebral discs, inhibiting fluid transfer and causing the discs to wear, dehydrate and degenerate. Over time, these individuals exhibit a significant loss of natural joint movement. Lack of natural movement in the spine over time causes a reduction in the imbibition of nutrient rich fluids that normally lubricate and maintain flexibility of the spine. Without this seepage of fluids into the spinal column, the discs will further dehydrate, which may result in further loss of mobility, crippling and possible nerve damage. It is further noted that the intervertebral discs' indigenous vascular fluid supply disappears at approximately 20 years of age. Thus, active nutrient transport of fluids surrounding the spinal column is particularly important to maintaining spinal health of adults.

In addition to spinal traction devices which are well known for stretching the spine longitudinally in order to restore lost mobility, devices have been developed for either passively or actively restoring the normal curves of the spine to prevent the disabling effects of lost or impaired curvature mentioned hereinabove. Passive devices include, for example, the Spinal Column Correction Device disclosed in U.S. Pat. No. 5,279,310 to Hsein. In this device, a user is strapped to a series of raised supports that define what the normal curvatures of the spine should be. According to the inventor, the weight of the user's body will bear against the raised supports to correct abnormal curvature in the spine. A useful device that actively exercises the normal lordotic, i.e. forward, curves of a spine is disclosed in U.S. Pat. No. 5,382,226 to Graham entitled Inflatable Cervical Traction and Exercising Device, this patent being incorporated herein by this specific reference thereto. In the Graham patent, a device is disclosed which utilizes an inflatable bladder for actively forcing the cervical spine into a forward semi-circular curve. This exercising of the spine promotes fluid imbibition through the spinal vertebrae and intervertebral discs.

U.S. Pat. No. 5,906,586 to Graham provides for a device and method for maintaining spinal health which utilizes a dual action air chamber defining multiple vectors of force to be applied to a spine, particularly to the lumbar spinal region. The device gradually lifts and separates the vertebrae in a manner that surpasses the effectiveness and comfort of conventional traction devices and passive spinal correction devices.

The present invention provides for a combination abdominal muscle and spine-exercising device utilizing the vectoring of the earlier Graham work and further providing for apparatus capable of exercising abdominal, low-back and pelvic muscles through a rocking action while the spine is simultaneously pneumatically molded into the accepted elliptical configuration of the thoraco-lumbar/lumbo-sacral spine.

SUMMARY OF THE INVENTION

An abdominal muscle and spine-exercising device in accordance with the present invention generally includes a frame having a top surface and a bottom surface. A first arched projection is disposed in the top surface along with a first inflatable bladder disposed on the first arched projection for directly bearing against lower thoracic and upper lumbar vertebrae of a users spine in a first direction.

A second inflatable bladder is disposed on the first arched projection for directly bearing against the mid-lumbar and lumbo-sacral vertebrae of the spine in a second direction. The first and second directions are divergent along a sagittal plane of the user in order to enhance an elliptical curve in the thoraco-lumbar/lumbo-sacral spine.

A second arched projection is disposed on the bottom surface for enabling the frame and bladders to be rocked by the user in a direction transverse to a longitudinal axis of the frame. This rocking action provides exercise for the abdominal, low-back and pelvic muscles while the spine is inflated into an elliptical shape. The rocking action also elevates and rolls the spine superiorly and inferiorly against the inflated air cells imparting multiple concussive force vectors to the spinal vertebra providing manipulative action.

Additionally, the rocking action enabled by the present invention provides momentum for spine, which is massaged and kneaded by the air bladders to not only effect elongation of the lordotic arch, but also to promote fluid imbibition throughout the vertebrae and discs. The stretching of the spine causes longitudinal alignment of the spinal vertebrae and the rocking action provides a therapy session for reinstating a lordotic arch in the spine as well as aligning the vertebrae along the longitudinal spinal axis. Thus the spine is trained and molded into its natural elliptical shape, the joints are lubricated and aligned and the abdominal, low-back and lumbo-pelvic muscles are exercised by the rocking action of the device.

More specifically, the first arch projection comprises a first sloped area and a second sloped area interconnected by a relatively flat area. Preferably, the first bladder is disposed on the flat area proximate the first sloped area and the second bladder is disposed on the flat area proximate the second sloped area.

More specifically, the bottom surface has a relatively flat portion and the second arch projection comprises an arcuate surface with the flat portion surrounding the arcuate surface.

The arcuate surface is symmetrical about the frame longitudinal axis thereby enabling rocking of the device in two directions with the same force enabling even distribution of the bladders against the spine.

The relatively flat portion surrounding the arcuate surface on the bottom provides for a limiting device with regard to the rocking action. That is, control of the transverse arcuate rotation is limited in order to effect proper spine training.

A method in accordance with the present invention includes the steps of providing a frame with a first and second bladder disposed on a top of the frame and a rocker disposed on a bottom of the frame.

The bladders are inflated in a bi-directional vectored manner in order to stretch, form and enhance an elliptical arc in the thoraco-lumbar/lumbo-sacral spine. Thereafter, the frame is rocked in order to massage and concussively form this spinal area against the air bladders while simultaneously exercising the abdominal, spinal and pelvic muscles.

BRIEF DESCRIPTION OF THE DRAWINGS

The present invention will be more readily understood in light of the following detailed description when considered in conjunction with the accompanying drawings of which.

DETAILED DESCRIPTION

With reference to FIGS. 1–4, there is shown an abdominal muscle and spine exercising device 10 which includes a frame 12 having a top surface 14 and a bottom surface 16.

Figure 1:
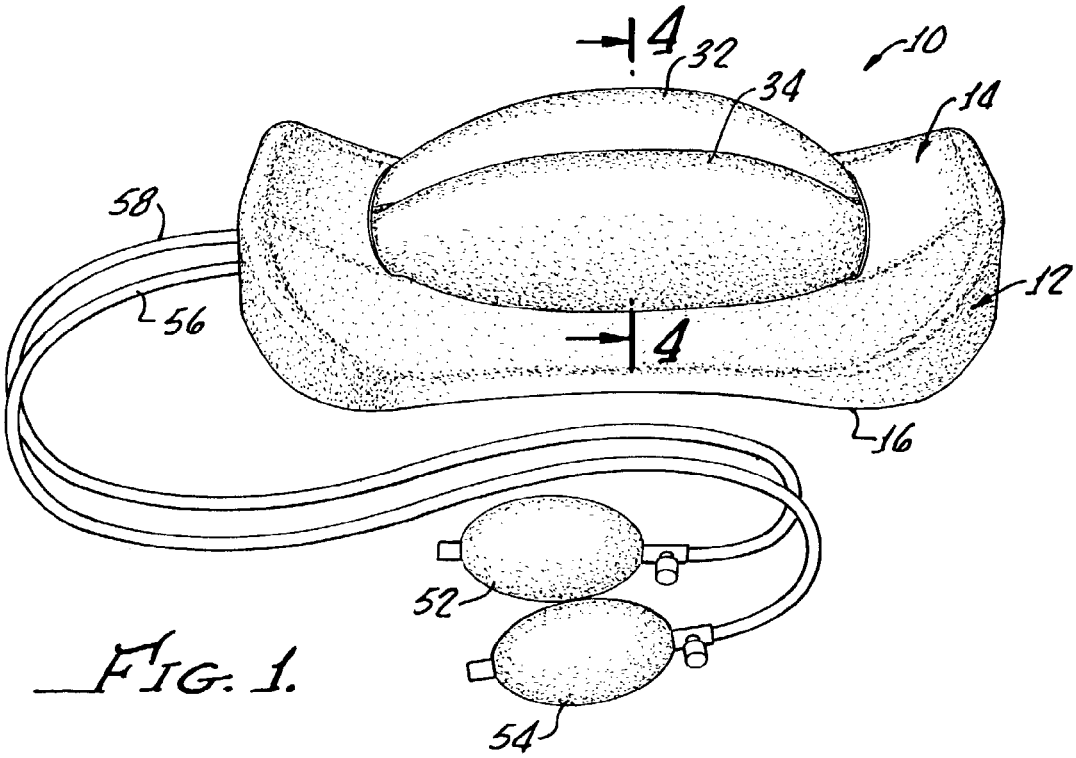
FIG. 1 is a perspective view of an abdominal muscle and spine-exercising device in accordance with the present invention generally showing a frame having a top surface with a first and second bladders disposed thereon and a pair of hand held pumps for bladder inflation.
Figure 2:
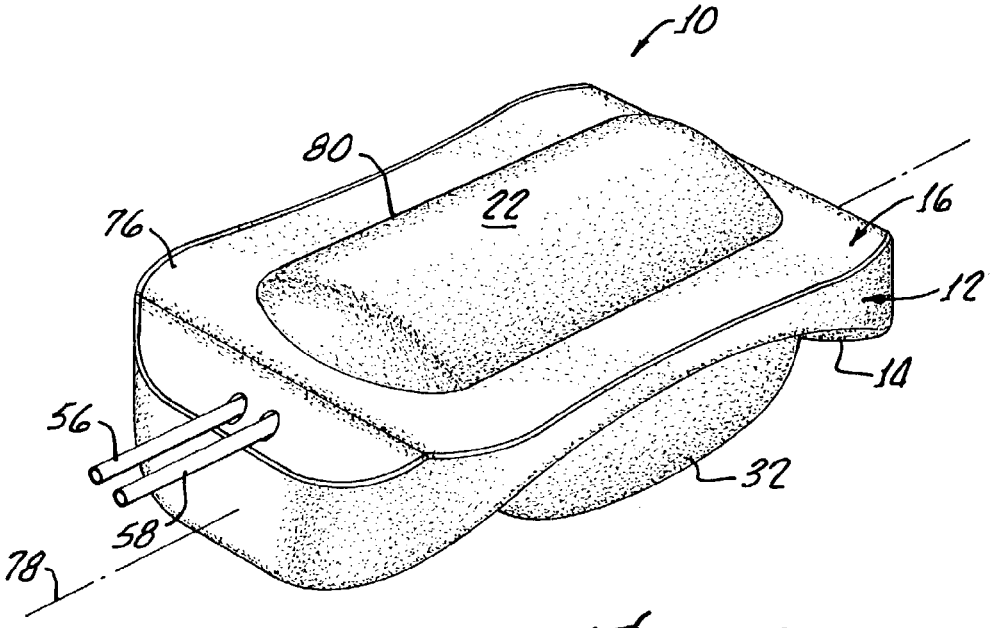
FIG. 2 is a perspective view of a bottom side of the device shown in FIG. 1 showing an arched projection for enabling the device to be rocked by the user.
Figure 3:
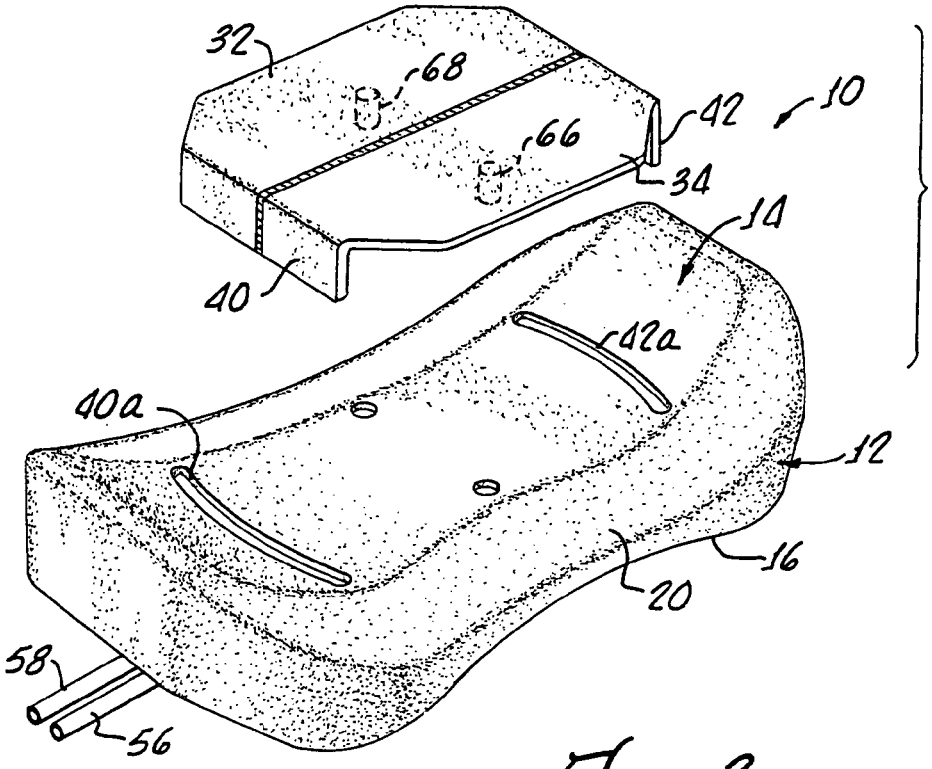
FIG. 3 is an exploded view of the device more clearly showing the disposition of the bladders on a relatively flat portion of the frame top side along with lines for coupling with the bladders to enable inflation thereof independently by the pumps.
Figure 4:
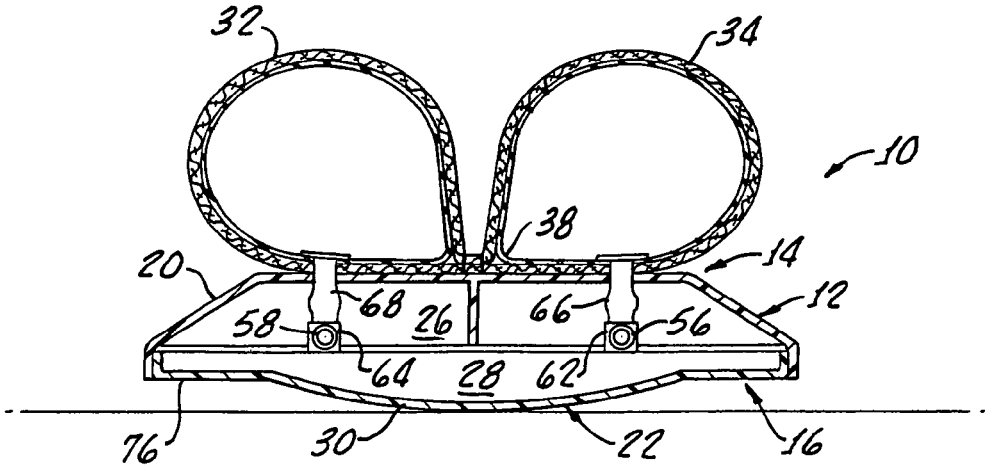
FIG. 4 is a cross sectional view of the device in accordance with the present invention taken along the line 4—4 of FIG. 1.

As best scene in FIGS. 1 and 3–4, the top surface 14 includes a first arched surface, or projection, 20 and, as best scene in FIG. 2 the bottom surface 16 includes an arched projection 22. The frame 12, which includes the top and bottom surfaces 14, 16 and arched projections 20, 22 is preferably molded from a suitable plastic. This structure includes hollow portions 26, 28, see FIG. 4, for enabling the device 10 to be made in a lightweight fashion and also enable innerconnection with first and second bladders 32, 34 which are disposed proximate a center 38 of the frame top surface 14.

The bladders 32, 34 may be attached to the top surface 14 by any suitable manner, for example depending portions 40, 42 may be fitted through corresponding slots 42*a*, 42*a* and fastened in any suitable manner.

Figure 5:
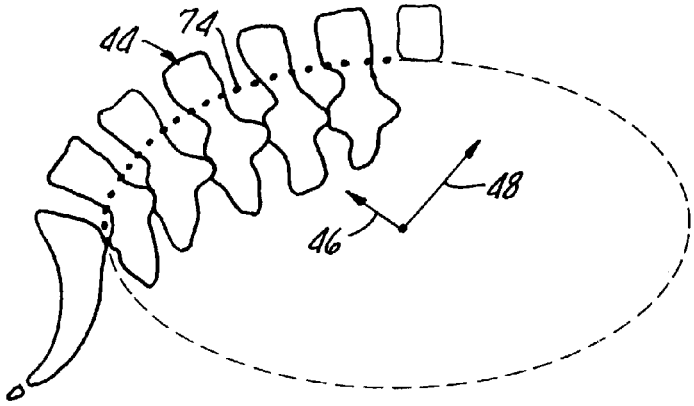
FIG. 5 is a diagram showing lumbar curvature as an 85° portion of an ellipse, this shape being the desired result of vectored forces provided by the bladders against the spine.

The first arch surface or projection 20 enables the first and second bladders 32, 34 to bear directly against the lower thoracic vertebrae of a users spine as illustrated in FIG. 5 by the arrows 46, 48. This vectored arrangement is described in U.S. Pat. No. 5,906,586 to Graham and is to be incorporated herewith in its entirety for describing a suitable bladders for use with the present invention and their position.

The bladders 32, 34 may be attached to one another as indicated in the drawings or separate, however each is pneumatically individual from the other enabling separate inflation and deflation through the use of hand pumps, or bulbs, 52, 54 inner connected to the bladders 32, 34 respectively through lines 56, 58 and fittings 62, 64 coupled to bladder nipples 66, 68, see also FIG. 4.

Again with reference to FIG. 5, the first and second bladder bearing directions 46, 48 are divergent along a saggital plane of the user 72 in order to enhance an elliptical arch 74 shown in FIG. 5 which enhances an elliptical arch in the thoraco-lumbar/lumbosarra/spine 44.

Figure 6:
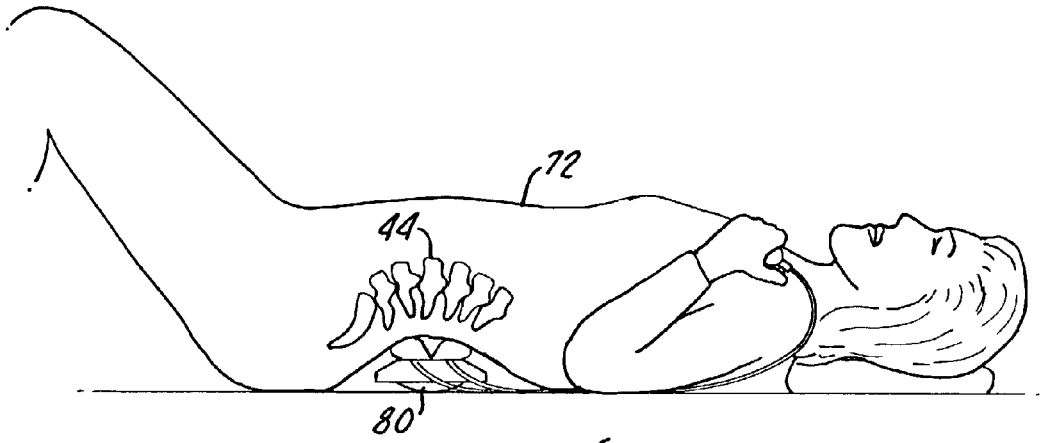
FIGS. 6–8 illustrate the use of the abdominal muscle and spine exercise device in accordance with the present invention illustrating massage by bladders due to momentum provided by rocking which effects the elongation of the lordotic arch and promotes fluid imbibition throughout the vertebrae and disc.
Figure 7:
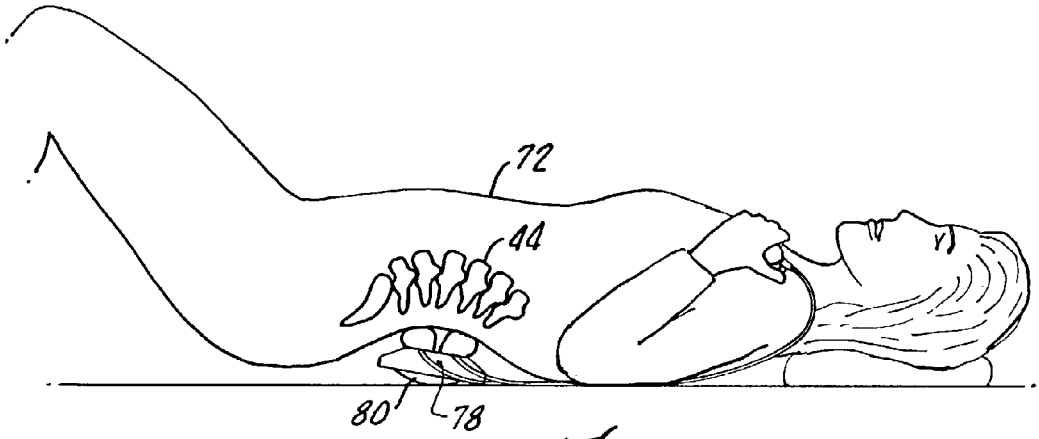
Figure 8:
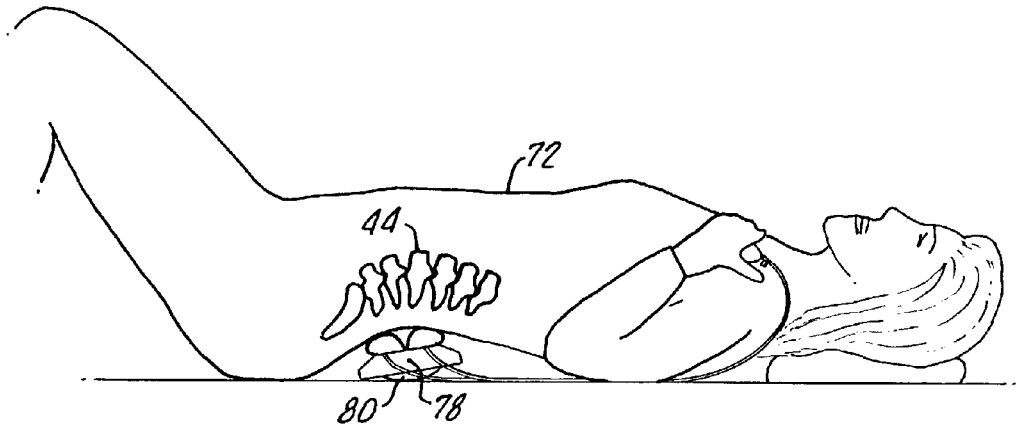

With specific reference to FIGS. 4, the frame bottom surface 16 includes the arched projection 22 which is preferably surrounded by a flat portion 76. The second arched projection 22 is disposed on the bottom surface 16 for enabling the frame 12 and bladders 32, 34 to be rocked by the user 72 as illustrated in FIGS. 6–8 in a direction transversed to a longitudinal axis 78 of the frame 12. As hereinabove noted, the flat portion 76 provides a stop for the rocking action.

In operation, the rocking action enabled by the arcuate surface works the users abdominal and pelvic muscles while the spine is urged into an elliptical shape. The momentum of the rocking against the urged elliptical shape promotes stretching of the spine which in turn causes longitudinal alignment of the spinal vertebrae 44 and thus provides therapy for reinstating a lordotic arch in the spine as well as aligning the vertebrae along a longitudinal spinal axis.

Although there has been hereinabove described a specific abdominal muscle and spine-exercising device in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclose herein. Accordingly, any and all modifications, variations or equivalent arrangements which may occur to those skilled in the art, should be considered to be within the scope of the present invention as defined in the appended claims.

What is claimed is:

1. An abdominal muscle and spine exercising device, the device comprising:

a frame for placement on a floor and having a top surface and a bottom surface;

a first generally concave surface disposed on said top surface having a flat center portion initially disposed parallel to said floor;

a first inflatable bladder disposed on the first generally concave surface center portion, for directly bearing against lower thoracic and upper lumbar vertebrae of a user's spine in a first direction;

a second inflatable bladder disposed, on the first generally concave surface center portion, for directly bearing against the mid-lumbar and lumbo-sacral vertebrae of the spine in a second direction, said first and second direction being divergent along a sagittal plane of the user in order to enhance an elliptical arc in the thoraco-lumbar/lumbo-sacral spinal region; and a second arched projection disposed on said bottom surface for enabling said frame and bladders to be rocked by the user in the direction transverse to a longitudinal axis of said frame.

2. The device according to claim 1 wherein the first and second bladders are disposed adjacent one another.

3. The device according to any one of claim 2 wherein said bottom surface has a relatively flat portion and said second arched projection comprises an arcuate surface.

4. The device according to claim 3 wherein the flat portion surrounds said arcuate surface.

5. The device according to claim 1 wherein said second arched projection comprises an arcuate surface.

6. The device according to claim 5 wherein said arcuate surface is symmetrical about the frame longitudinal axis.

7. The device according to claim 6 wherein the first and second bladders are disposed adjacent one another.

8. The device according to claim 7 wherein said bottom surface has a relatively flat portion and said second arched projection comprises an arcuate surface.

9. The device according to claim 8 wherein the flat portion surrounds said arcuate surface.

10. A method for muscle and spine exercising comprising the steps of:

providing a frame with first and second bladders disposed on a top of said frame and a rocker projection disposed on a bottom of said frame;

inflating a bladder bearing against the lower thoracic and upper lumbar vertebrae in one direction and inflating another bladder bearing against the middle lumbar and lumbo-sacral vertebra in a different direction in order to stretch, form and enhance an elliptical arc in the lower spinal region; and rocking the frame imparting multiple concussive force vectors to the spinal vertebra in order to massage, knead, stretch, form, manipulate and align the spine with the bladders.

* * * * *